US011322089B2

(12) United States Patent
Heo et al.

(10) Patent No.: US 11,322,089 B2
(45) Date of Patent: May 3, 2022

(54) DISPLAY HAVING HOLE AREA AND ELECTRONIC DEVICE COMPRISING SAME

(71) Applicant: Samsung Electronics Co., Ltd., Suwon-si (KR)

(72) Inventors: Changryong Heo, Suwon-si (KR); Chihyun Cho, Suwon-si (KR); Minuk Kim, Suwon-si (KR); Hyoseok Na, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/733,142

(22) PCT Filed: Dec. 28, 2018

(86) PCT No.: PCT/KR2018/016891
§ 371 (c)(1),
(2) Date: May 28, 2020

(87) PCT Pub. No.: WO2019/132603
PCT Pub. Date: Jul. 4, 2019

(65) Prior Publication Data

US 2020/0294448 A1 Sep. 17, 2020

(30) Foreign Application Priority Data

Dec. 28, 2017 (KR) ..... 10-2017-0183125

(51) Int. Cl.
*G09G 3/3241* (2016.01)
*G09G 3/3275* (2016.01)

(52) U.S. Cl.
CPC ..... *G09G 3/3241* (2013.01); *G09G 3/3275* (2013.01); *G09G 2300/0439* (2013.01); *G09G 2320/046* (2013.01); *G09G 2330/028* (2013.01)

(58) Field of Classification Search
CPC .. G09G 3/3225; G09G 3/3233; G09G 3/3241; G09G 3/3275; G09G 2300/0439;
(Continued)

(56) References Cited

U.S. PATENT DOCUMENTS 9,396,681 B2 7/2016 In et al.
9,747,858 B2 * 8/2017 Wu ..... G09G 3/3688
(Continued)

FOREIGN PATENT DOCUMENTS

KR 10-2011-0030886 A 3/2011
KR 10-2016-0096791 A 8/2016
(Continued)

OTHER PUBLICATIONS

International Search Report and Written Opinion of the International Searching Authority in connection with International Application No. PCT/KR2018/016891 dated Apr. 2, 2019, 10 pages.
(Continued)

*Primary Examiner* — Mihir K Rayan

(57) ABSTRACT

A display is disclosed. A display according to various embodiments may comprise: a panel comprising a first pixel line comprising multiple first pixels formed in a first direction and a second pixel line comprising multiple second pixels formed in the first direction; a first wire for supplying power to the multiple first pixels included in the first pixel line; a second wire for supplying power to the multiple second pixels included in the second pixel line; and a compensation circuit electrically connected to the second wire, and compensating for an impedance corresponding to the difference in number between the multiple first pixels and the multiple second pixels. A display according to various embodiments may comprise: a panel comprising a first pixel line comprising multiple first pixels formed in a first direction and a second pixel line comprising multiple
(Continued)

second pixels formed in the first direction; a first wire for supplying first power to the multiple first pixels included in the first pixel line; a second wire for supplying second power to the multiple second pixels included in the second pixel line; and a display driver IC configured to apply a first ELVdd and a first ELVss, which corresponds to the first ELVdd, to the first pixel line as first power and to apply a second ELVdd and a second ELVss, which corresponds to the second ELVdd, to the second pixel line as second power. Various other embodiments may also be provided.

14 Claims, 14 Drawing Sheets

(58) Field of Classification Search
CPC ..... G09G 2320/0223; G09G 2320/046; G09G 2330/0028
See application file for complete search history.

(56) References Cited

U.S. PATENT DOCUMENTS 10,354,578 B2 * 7/2019 Ka ..... G09G 3/3225
10,854,125 B2 * 12/2020 Tsai ..... G11C 19/287
11,075,222 B2 * 7/2021 Park ..... H01L 27/1218
11,120,737 B2 * 9/2021 Kim ..... H01L 27/326
11,151,926 B2 * 10/2021 Ka ..... G09G 3/3233
11,189,680 B2 * 11/2021 Kim ..... H01L 27/3276
2005/0001794 A1 * 1/2005 Nakanishi ..... G09G 3/006 345/76
2005/0168491 A1 * 8/2005 Takahara ..... H01L 27/3244 345/690
2007/0146253 A1 * 6/2007 Tang ..... G09G 3/3208 345/77
2011/0069059 A1 3/2011 Lee et al.
2011/0102384 A1 * 5/2011 Huang ..... G09G 3/3685 345/204
2011/0279433 A1 11/2011 Ryu
2015/0348463 A1 * 12/2015 Lee ..... G09G 3/3233 345/690
2016/0012768 A1 * 1/2016 In ..... G09G 3/3225 345/212
2016/0012776 A1 * 1/2016 Kong ..... G09G 3/3258 345/211
2016/0111040 A1 * 4/2016 Kim ..... G09G 3/2096 345/698
2016/0232854 A1 8/2016 Lee
2016/0329350 A1 11/2016 Na et al.
2017/0154060 A1 6/2017 Rangappa et al.
2017/0154945 A1 * 6/2017 Shin ..... H01L 27/3276
2017/0249882 A1 8/2017 Lee
2017/0249906 A1 8/2017 Noh et al.
2017/0316744 A1 11/2017 Oh et al.
2018/0129106 A1 * 5/2018 Gao ..... G09G 3/3611
2021/0066428 A1 * 3/2021 Tao ..... G09G 3/3233

FOREIGN PATENT DOCUMENTS

KR 10-2016-0132265 A 11/2016
KR 10-2017-0061783 A 6/2017
KR 10-2017-0102130 A 9/2017
KR 10-2017-0102146 A 9/2017
KR 10-2017-0102148 A 9/2017
KR 10-2017-0124684 A 11/2017

OTHER PUBLICATIONS

Notification of the Reasons for Rejection dated Feb. 18, 2022, in connection with Korean Application No. 10-2017-0183125, 17 pages.

* cited by examiner

DISPLAY HAVING HOLE AREA AND ELECTRONIC DEVICE COMPRISING SAME

CROSS-REFERENCE TO RELATED APPLICATIONS

This application is a National Phase Entry of PCT International Application No. PCT/KR2018/016891, which was filed on Dec. 28, 2018 and claims priority to Korean Patent Application No. 10-2017-0183125, which was filed on Dec. 28, 2017, the contents of which are incorporated herein by reference.

BACKGROUND

1. Field

Various embodiments relate to controlling the display of an electronic device and specifically to a display with a hole area and an electronic device including the display.

2. Description of the Related Art

A display driver integrated circuit (DDI) is a module for receiving control signals and image data (e.g., image frames) from the main processor (e.g., an application processor) of an electronic device to drive each pixel of the display panel. At this time, necessary power may be supplied from an external power source.

The display panel is a substantial medium for displaying information, such as a TFT-LCD, PDP, or OLED. In particular, OLED panels have recently come into wide use thanks to their high response speed and no issues with angle-of-field by their nature of adopting organic electroluminescent (EL) devices as pixels. Each pixel of the OLED panel consists of a transistor and an EL light emitting material, and the pixels may be connected, in a grid pattern, with a gate driver and a source driver.

Recently there is ongoing discussion about display structures with a hole formed in a portion of the display panel to secure a space for placing a front camera for the electronic device upon equipping the electronic device with the display.

SUMMARY

In a display structure with a hole area cut in a portion of the display panel apart from where the components of the electronic device are arranged, although the display driver IC applies the same pixel driving voltage, the level of the voltage to the pixels arranged in the area corresponding to the hole area of the display may be increased and, thus, burn-in may occur in the pixels in the display area including the hole area.

According to various embodiments, it is possible to supply the same electroluminescence (EL) voltage to each pixel in the display panel by placing a compensation circuit in the hole area or controlling pixel driving voltages to differ per area.

According to various embodiments, a display may comprise a panel including a first pixel line including a first plurality of pixels formed in a first direction and a second pixel line including a second plurality of pixels formed in the first direction, a first trace for supplying power to the first plurality of pixels included in the first pixel line, a second trace for supplying the power to the second plurality of pixels included in the second pixel line, and a compensation circuit electrically connected with the second trace and configured to compensate for an impedance corresponding to a difference in number between the first plurality of pixels and the second plurality of pixels.

According to various embodiments, an electronic device may comprise a panel including a first pixel line including a first plurality of pixels formed in a first direction and a second pixel line including a second plurality of pixels formed in the first direction, a first trace for supplying power to the first plurality of pixels included in the first pixel line, a second trace for supplying the power to the second plurality of pixels included in the second pixel line, and a display driver IC configured to apply a first EL voltage and a second EL voltage to the first pixel line and a third EL voltage and a fourth EL voltage to the second pixel line.

According to various embodiments, a display may comprise a first pixel line including a first plurality of pixels formed in a first direction, a second pixel line including a second plurality of pixels formed in the first direction, a first trace for supplying power to the first plurality of pixels included in the first pixel line, a second trace for supplying the power to the second plurality of pixels included in the second pixel line, and a compensation circuit electrically connected with the second trace and configured to compensate for an electrical load corresponding to a difference in number between the first plurality of pixels and the second plurality of pixels.

According to various embodiments, a display may comprise a panel including a first trace for supplying power to a first plurality of pixels included in a first pixel line, a second trace for supplying the power to a second plurality of pixels included in a second pixel line, the first pixel line including the first plurality of pixels formed in a first direction, and the second pixel line including the second plurality of pixels formed in the first direction, and a display driver IC configured to apply a first EL voltage and a second EL voltage to the first pixel line and a third EL voltage and a fourth EL voltage to the second pixel line.

According to various embodiments, it may be possible to address the issue that brightness is varied per area upon cutting a portion of the display panel and prevent burn-in in pixels in a specific area to enhance the quality of display.

DETAILED DESCRIPTION

Figure 1:
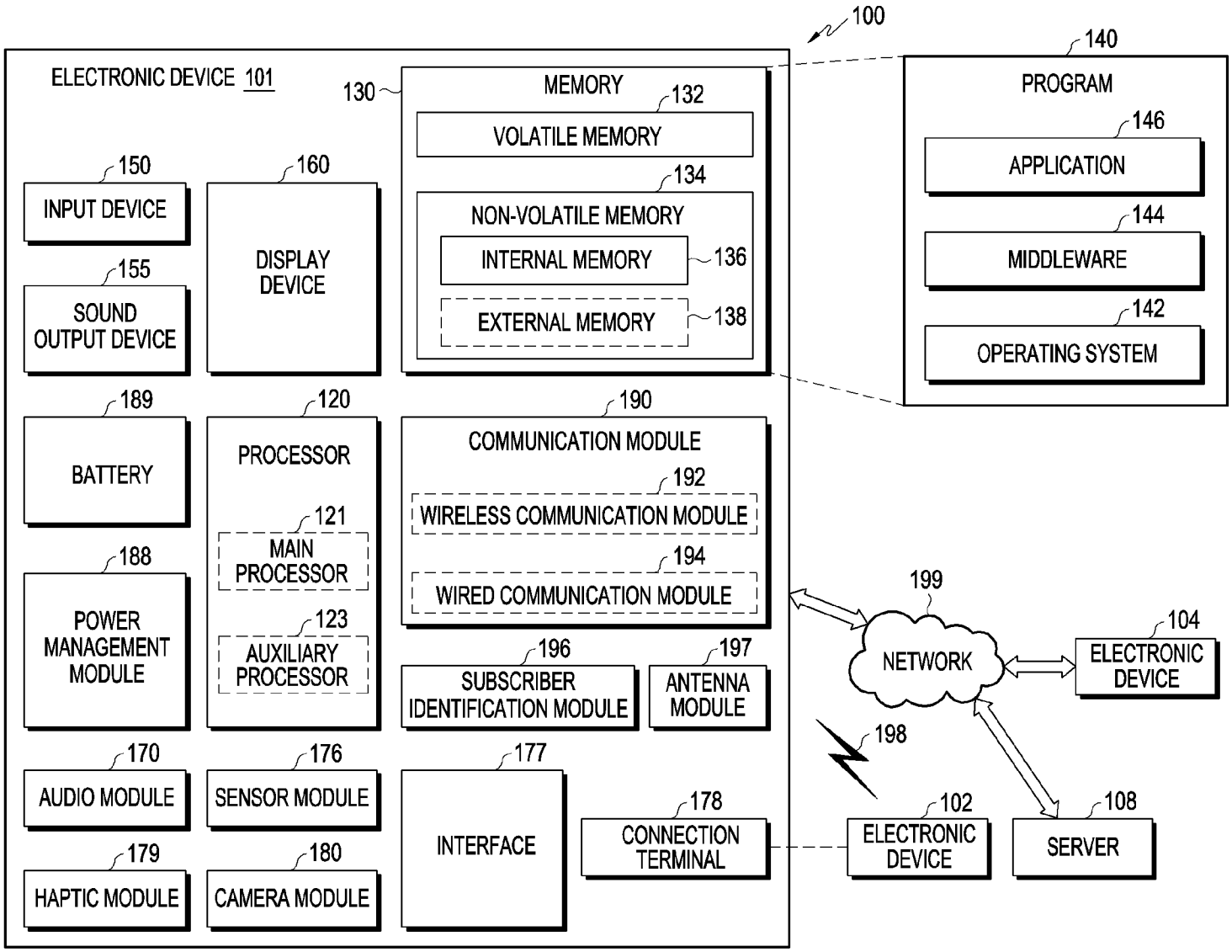
FIG. 1 illustrates a network environment including an electronic device according to an embodiment of the present disclosure.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, a memory 130, an input device 150, a sound output device 155, a display device 160, an audio module 170, a sensor module 176, an interface 177, a haptic module 179, a camera module 180, a power management module 188, a battery 189, a communication module 190, a subscriber identification module 196, and an antenna module 197. In some embodiments, the electronic device 101 may exclude at least one (e.g., the display device 160 or the camera module 180) of the components or add other components. In some embodiments, some components may be implemented to be integrated together, e.g., as if the sensor module 176 (e.g., a fingerprint sensor, an iris sensor, or an illuminance sensor) is embedded in the display device (160) (e.g., a display).

The processor 120 may drive, e.g., software (e.g., a program 140) to control at least one other component (e.g., a hardware or software component) of the electronic device 101 connected with the processor 120 and may process or compute various data. The processor 120 may load and process an instruction or data received from another component (e.g., the sensor module 176 or the communication module 190) on a volatile memory 132, and the processor 120 may store resultant data in a non-volatile memory 134. According to an embodiment, the processor 120 may include a main processor 121 (e.g., a central processing unit (CPU) or an application processor), and additionally or alternatively, an auxiliary processor 123 (e.g., a graphics processing unit (GPU), an image signal processor, a sensor hub processor, or a communication processor) that is operated independently from the main processor 121 and that consumes less power than the main processor 121 or is specified for a designated function. Here, the auxiliary processor 123 may be operated separately from or embedded in the main processor 121.

In such case, the auxiliary processor 123 may control at least some of functions or states related to at least one (e.g., the display device 160, the sensor module 176, or the communication module 190) of the components of the electronic device 101, instead of the main processor 121 while the main processor 121 is in an inactive (e.g., sleep) state or along with the main processor 121 while the main processor 121 is an active state (e.g., performing an application). According to an embodiment, the auxiliary processor 123 (e.g., an image signal processor or a communication processor) may be implemented as part of another component (e.g., the camera module 180 or the communication module 190) functionally related to the auxiliary processor 123. The memory 130 may store various data used by at least one component (e.g., the processor 120 or sensor module 176) of the electronic device 101, e.g., software (e.g., the program 140) and input data or output data for a command related to the software. The memory 130 may include the volatile memory 132 or the non-volatile memory 134.

The program 140, as software stored in the memory 130, may include, e.g., an operating system (OS) 142, middleware 144, or an application 146.

The input device 150 may be a device for receiving a command or data, which is to be used for a component (e.g., the processor 120) of the electronic device 101, from an outside (e.g., a user) of the electronic device 101. The input device 2650 may include, e.g., a microphone, a mouse, or a keyboard.

The sound output device 155 may be a device for outputting sound signals to the outside of the electronic device 101. The sound output device 155 may include, e.g., a speaker which is used for general purposes, such as playing multimedia or recording and playing, and a receiver used for call receiving purposes only. According to an embodiment, the receiver may be formed integrally or separately from the speaker.

The display 160 may be a device for visually providing information to a user of the electronic device 101. The display device 160 may include, e.g., a display, a hologram device, or a projector and a control circuit for controlling the display, hologram device, or projector. According to an embodiment, the display device 160 may include touch circuitry or a pressure sensor capable of measuring the strength of a pressure for a touch.

The audio module 170 may convert a sound into an electrical signal and vice versa. According to an embodiment, the audio module 170 may obtain a sound through the input device 150 or output a sound through the sound output device 155 or an external electronic device (e.g., an electronic device 102 (e.g., a speaker or a headphone) wiredly or wirelessly connected with the electronic device 101.

The sensor module 176 may generate an electrical signal or data value corresponding to an internal operating state (e.g., power or temperature) or external environmental state of the electronic device 101. The sensor module 176 may include, e.g., a gesture sensor, a gyro sensor, an atmospheric pressure sensor, a magnetic sensor, an acceleration sensor, a grip sensor, a proximity sensor, a color sensor, an infrared (IR) sensor, a bio sensor, a temperature sensor, a humidity sensor, or an illuminance sensor.

The interface 177 may support a designated protocol enabling a wired or wireless connection with an external electronic device (e.g., the electronic device 102). According to an embodiment, the interface 177 may include a high definition multimedia interface (HDMI), a universal serial bus (USB) interface, a secure digital (SD) card interface, or an audio interface.

A connecting terminal 178 may include a connector, e.g., a HDMI connector, a USB connector, an SD card connector, or an audio connector (e.g., a headphone connector), which is able to physically connect the electronic device 101 with an external electronic device (e.g., the electronic device 102).

The haptic module 179 may convert an electrical signal into a mechanical stimulus (e.g., a vibration or motion) or electrical stimulus which may be recognized by a user via his tactile sensation or kinesthetic sensation. The haptic module 179 may include, e.g., a motor, a piezoelectric element, or an electric stimulator.

The camera module 180 may capture a still image or moving images. According to an embodiment, the camera module 180 may include one or more lenses, an image sensor, an image signal processor, or a flash.

The power management module 188 may be a module for managing power supplied to the electronic device 101. The power management module 188 may be configured as at least part of, e.g., a power management integrated circuit (PMIC).

The battery 189 may be a device for supplying power to at least one component of the electronic device 101. The battery 189 may include, e.g., a primary cell which is not rechargeable, a secondary cell which is rechargeable, or a fuel cell.

The communication module 190 may support establishing a wired or wireless communication channel between the electronic device 101 and an external electronic device (e.g., the electronic device 102, the electronic device 104, or the server 108) and performing communication through the established communication channel. The communication module 190 may include one or more communication processors that are operated independently from the processor 120 (e.g., an application processor) and supports wired or wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of the wireless communication module 192 and the wired communication module 194 may be used to communicate with an external electronic device through a first network 198 (e.g., a short-range communication network, such as Bluetooth, wireless-fidelity (Wi-Fi) direct, or infrared data association (IrDA)) or a second network 199 (e.g., a long-range communication network, such as a cellular network, the Internet, or a communication network (e.g., LAN or wide area network (WAN)). The above-enumerated types of communication modules 190 may be implemented in a single chip or individually in separate chips.

According to an embodiment, the wireless communication module 192 may differentiate and authenticate the electronic device 101 in the communication network using user information stored in the subscriber identification module 196.

The antenna module 197 may include one or more antennas for transmitting or receiving a signal or power to/from an outside. According to an embodiment, the communication module 190 (e.g., the wireless communication module 192) may transmit or receive a signal to/from an external electronic device through an antenna appropriate for a communication scheme.

Some of the above-described components may be connected together through an inter-peripheral communication scheme (e.g., a bus, general purpose input/output (GPIO), serial peripheral interface (SPI), or mobile industry processor interface (MIPI)), communicating signals (e.g., instructions or data) therebetween.

According to an embodiment, instructions or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations executed on the electronic device 101 may be run on one or more other external electronic devices. According to an embodiment, when the electronic device 101 should perform a certain function or service automatically or at a request, the electronic device 101, instead of, or in addition to, executing the function or service on its own, may request an external electronic device to perform at least some functions associated therewith. The external electronic device (e.g., electronic devices 102 and 104 or server 106) may execute the requested functions or additional functions and transfer a result of the execution to the electronic device 101. The electronic device 101 may provide a requested function or service by processing the received result as it is or additionally. To that end, a cloud computing, distributed computing, or client-server computing technology may be used, for example.

Figure 2:
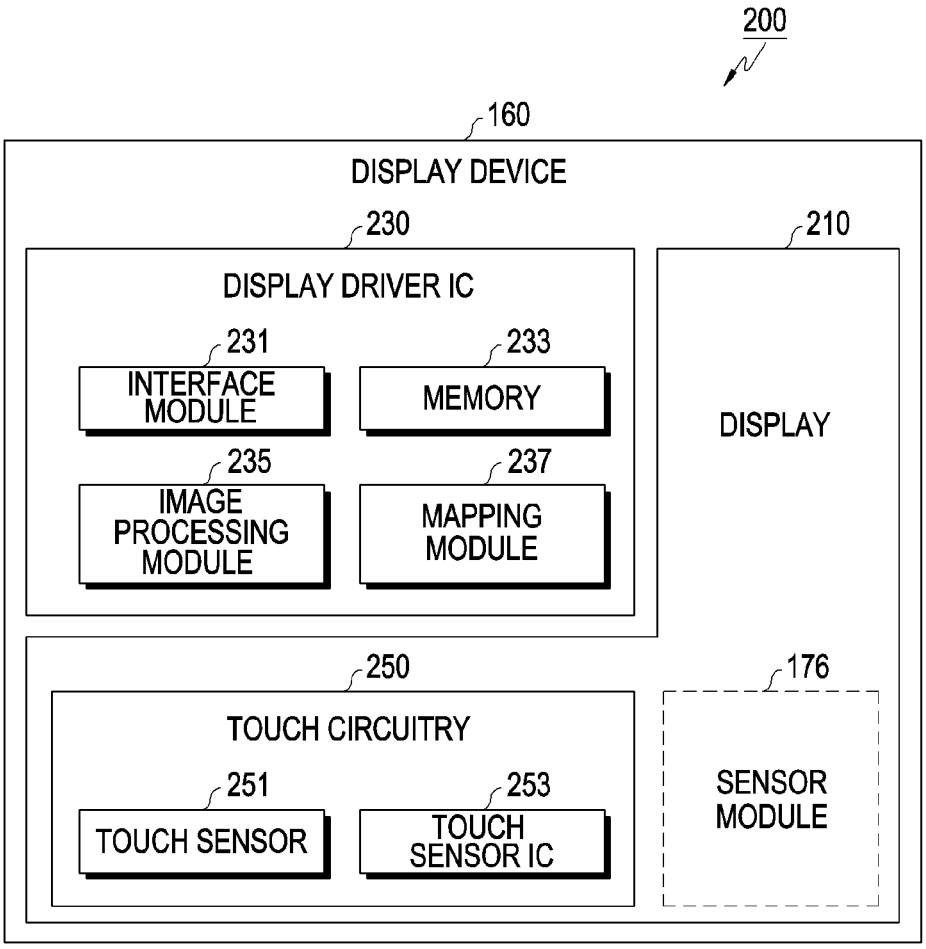
FIG. 2 is a block diagram illustrating a display device according to various embodiments.

FIG. 2 is a block diagram 200 illustrating the display device 160 according to an embodiment. Referring to FIG. 2, the display device 160 may include a display 210 and a display driver integrated circuit (DDI) 230 to control the display 110. The DDI 230 may include an interface module 231, memory 233 (e.g., buffer memory), an image processing module 235, or a mapping module 237. The DDI 230 may receive image information that contains image data or an image control signal corresponding to a command for controlling the image data from the processor 120 (e.g., the main processor 121 (e.g., an application processor) or the auxiliary processor 123 operated independently from the function of the main processor 121) through, e.g., the interface module 231. The DDI 230 may communicate, for example, with touch circuitry 250 or the sensor module 176 via the interface module 231. The DDI 230 may also store at least part of the received image information in the memory 233, for example, on a frame by frame basis. The image processing module 235 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 210. The mapping module 237 may convert the image data pre- or post-processed by the image processing module 135 into a voltage value or current value at which pixels of the display 210 may be driven, based on, at least, at least part of attributes of the pixels (e.g., the array (RGB stripe or pentile)) of the pixels or the size of each subpixel). At least some pixels of the display 210 may be driven based on, e.g., the voltage value or current value so that visual information (e.g., text, image, or icon) corresponding to the image data may be displayed on the display 210.

According to an embodiment, the display device 160 may further include the touch circuitry 250. The touch circuitry 250 may include a touch sensor 251 and a touch sensor IC 253 to control the touch sensor 151. The touch sensor IC 253 may control the touch sensor 251, sense a touch input or hovering input at a particular position of the display 210, e.g., by measuring a variation in a signal (e.g., a voltage, quantity of light, resistance, or quantity of electric charge) for the particular position of the display 210, and provide information (e.g., the position, area, pressure, or time) regarding the sensed touch input or hovering input to the processor 120. According to an embodiment, at least part (e.g., the touch sensor IC 253) of the touch circuitry 250 may be formed as part of the display 210 or the DDI 230, or as part of another component (e.g., the auxiliary processor 123) disposed outside the display device 160.

According to an embodiment, the display device 160 may further include at least one sensor (e.g., a fingerprint sensor, an iris sensor, a pressure sensor, or an illuminance sensor) of the sensor module 176 or a control circuit for the at least one sensor. In such a case, the at least one sensor or the control circuit for the at least one sensor may be embedded in one portion of a component (e.g., the display 210, the DDI 230, or the touch circuitry 250)) of the display device 160. For example, when the sensor module 176 embedded in the display device 160 includes a biometric sensor (e.g., a fingerprint sensor), the biometric sensor may obtain biometric information (e.g., a fingerprint image) corresponding to a touch input received via a portion of the display 210. As another example, when the sensor module 176 embedded in the display device 160 includes a pressure sensor, the pressure sensor may obtain pressure information corresponding to a touch input received via a partial or whole area of the display 210. According to an embodiment, the touch sensor 251 or the sensor module 176 may be disposed between pixels in a pixel layer of the display 210, or over or under the pixel layer.

Figure 3:
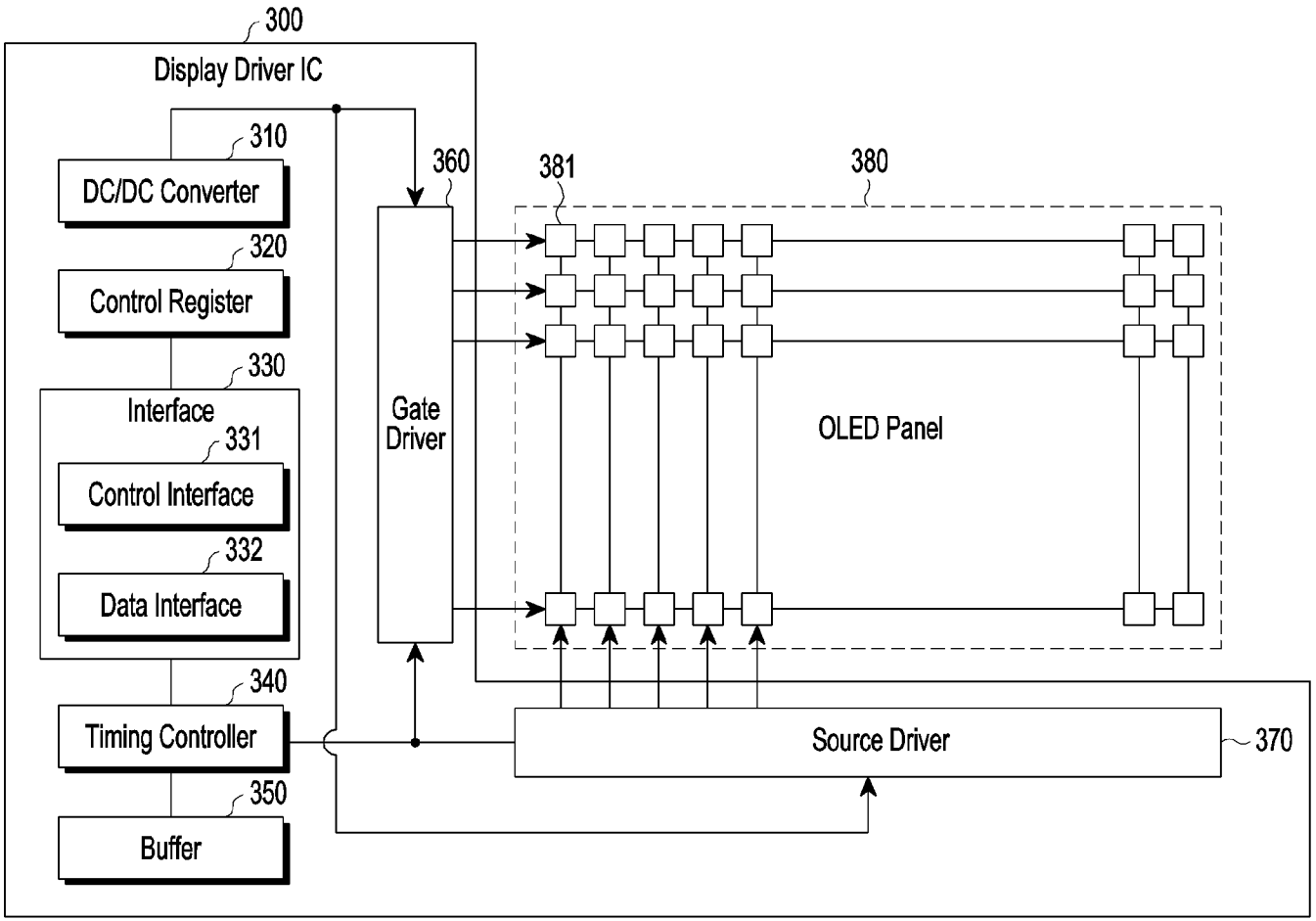
FIG. 3 is a block diagram illustrating a display driver IC and a display panel according to various embodiments.

FIG. 3 is a block diagram illustrating a display driver IC and a display panel according to various embodiments.

According to various embodiments, a display driver IC (e.g., the DDI 230 of FIG. 2, hereinafter, "DDI") may collectively denote modules for receiving control signals and image data (e.g., image frames) from the main processor (e.g., the processor 120 of FIG. 1) of the electronic device to drive each pixel. The display driver IC may include a direct current/direct current (DC/DC) converter 310, a control register 320, an interface 320, a timing controller 340, a buffer 350, a gate driver 360, and a source driver 370. The DC/DC converter 310 of the DDI 300 may collectively denote devices that convert low-voltage direct current into alternating current (AC), voltage-transform the AC, and rectify the voltage-transformed AC into higher-voltage DC. The DC/DC converter 310 may receive power for driving the display driver IC 300 from an external power source (not shown). For example, the external power source (not shown) may be a battery 189 embedded in the electronic device (e.g., the electronic device 101 of FIG. 1). The control register 320 may be connected to the interface 330 and, if the interface 330 receives a control signal and image data (e.g., an image frame) from the electronic device (e.g., the processor 120 of FIG. 1), the control register 320 may control to drive the display driver IC 300 based on the received control signal or image data.

According to various embodiments, the interface 330 may include a control interface 331 and a data interface 332. The control interface 331 may receive control signals from the processor (e.g., the processor 120 of FIG. 1) of the electronic device 101, and the data interface 332 may receive image data to be displayed on the display panel 360 from the processor 120. The timing controller 340 may be connected to the interface 330, buffer 350, gate driver 360, and source driver 370 and control the timing of controlling the buffer 350, gate driver 360, and source driver 370 using the control signal and image data received from the interface 330. The buffer 350 may be a refresh memory included in the display driver IC (e.g., the display driver 230 of FIG. 2) and may store data converted into pixel representations as at least one or more frames. The buffer 350 may output the stored frames on the display according to a refresh rate (e.g., 60 Hz), based on the signal received from the interface 330 and may store new frames.

According to various embodiments, the gate driver 360 may be connected with the DC/DC converter 310 and the timing controller 340 and may be connected to the pixel 381 included in the display panel 380 via a trace. The gate driver 360 may be supplied power from the DC/DC converter 310 and be driven, and the gate driver 360 may receive a control signal and data signal from the timing controller 340 and apply a voltage to a switching thin film transistor (TFT) of the pixel 381 in the display panel 380. A configuration in which the gate driver 360 applies voltage to the pixel 381 is described below with reference to FIG. 4. The source driver 370 may be connected with the DC/DC converter 310 and the timing controller 340 and may be connected to the pixel 381 included in the display panel 380 via a trace. The source driver 370 may be supplied power from the DC/DC converter 310 and be driven, and the source driver 370 may receive a control signal and data signal from the timing controller 340 and apply a voltage to a driving TFT of the pixel 381 in the display panel 380. A configuration in which the source driver 370 applies voltage to the pixel 381 is described below with reference to FIG. 4. The gate driver 360 and the source driver 370 may provide voltages in directions perpendicular to each other and may provide voltages to each pixel.

According to various embodiments, the display panel 380, as a medium for displaying a screen based on the control signal and image data received from the processor (e.g., the processor 120 of FIG. 1), may include, e.g., a thin film transistor-liquid crystal display (TFT-LCD), plasma display panel (PDP), or organic light emitting diode (OLED) display. Each pixel 381 in the display panel 380 is the minimum unit constituting an image, consists of a transistor and an electro-luminescence (EL) light emitting material, and may be connected, in a grid pattern, with the gate driver 360 and source driver 370 of the display driver IC 300. Each pixel 381 included in the display panel 380 may receive power from the gate driver 360 and source driver 370 to enable the diode in the pixel 381 to emit light, thereby allowing the image data received from the processor (e.g., the processor 120 of FIG. 1) to be displayed on the display panel.

Figure 4:
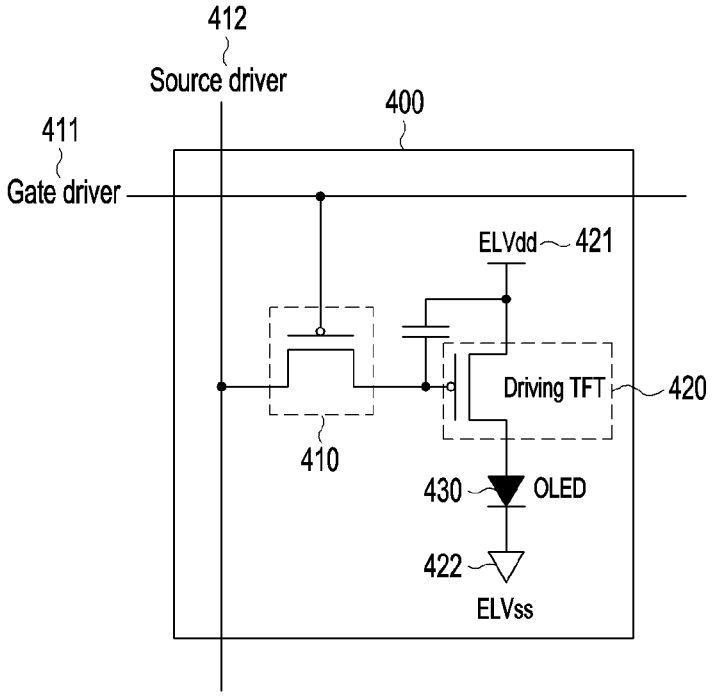
FIG. 4 is an example circuit diagram illustrating a pixel included in a display panel according to various embodiments.

FIG. 4 is an example circuit diagram illustrating a pixel included in a display panel according to various embodiments.

According to various embodiments, a pixel 400 (e.g., the pixel 381 of FIG. 3) may include a switching TFT 410, a driving TFT 420, and a diode 430. The diode 430 may be, e.g., an OLED. The switching TFT 410 may be connected with a gate driver 411 (e.g., the gate driver 360 of FIG. 3) and source driver 412 (e.g., the source driver 370 of FIG. 3) of a display driver IC (e.g., the display driver IC 300 of FIG. 3). A voltage applied from the gate driver 360 to the switching TFT 410 may be higher than a threshold voltage of the switching TFT 410 so that the pixel 400 may be turned on/off based on the voltage applied from the gate driver 411. If the voltage applied from the gate driver 411 is higher than the threshold voltage of the switching TFT 410, the switching TFT 410 may be opened so that the voltage applied from the source driver 412 is applied as the gate voltage of the driving TFT 420. The driving TFT 420 may be connected with the source driver 412 of the display driver IC (e.g., the display driver IC 300 of FIG. 3), and the source driver 412 may apply a voltage to the gate of the driving TFT 420 according to the pixel data. The gate voltage of the driving TFT 420 may be a voltage applied from the source driver 412 via the switching TFT 410. In the driving TFT 420, the amount of current flowing from the ELVdd 421 to the ELVss 422 may be adjusted in proportion to the magnitude of voltage applied from the source driver 412 to the driving TFT 420. The ELVdd 421 and the ELVss 422 may be applied to the pixel 400 via traces and allow the current flowing from the ELVdd 421 to the ELVss 422 to be adjusted based on the magnitude of threshold voltage. If the amount of current flowing from the ELVdd 421 to the ELVss 422 is adjusted, the brightness of OLED 430 may be adjusted depending on the amount of the flowing current.

Figure 5A:
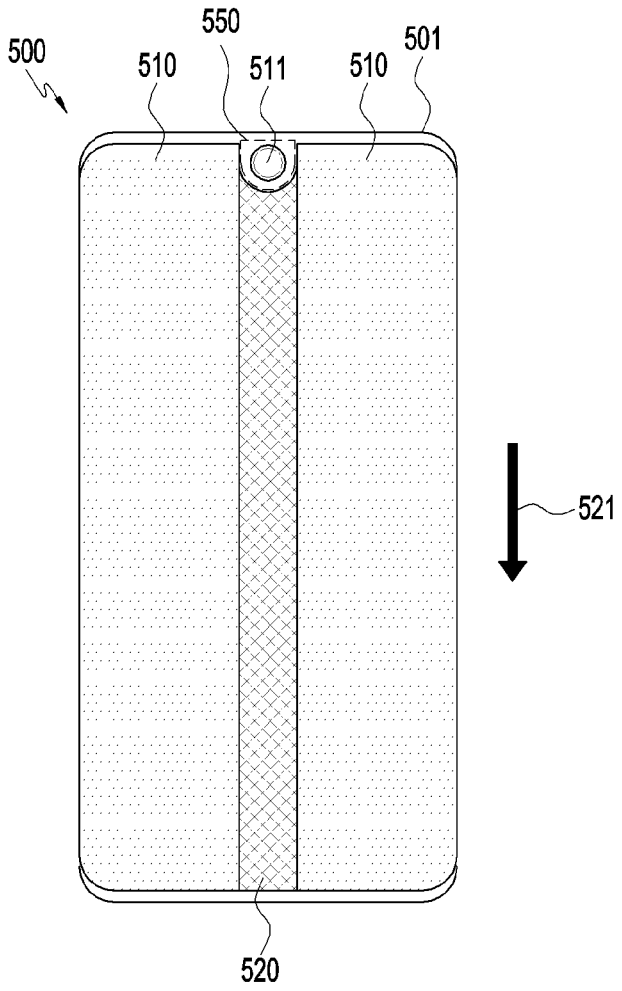
FIG. 5A is an example view illustrating a display panel with a hole area according to various embodiments.
Figure 5B:
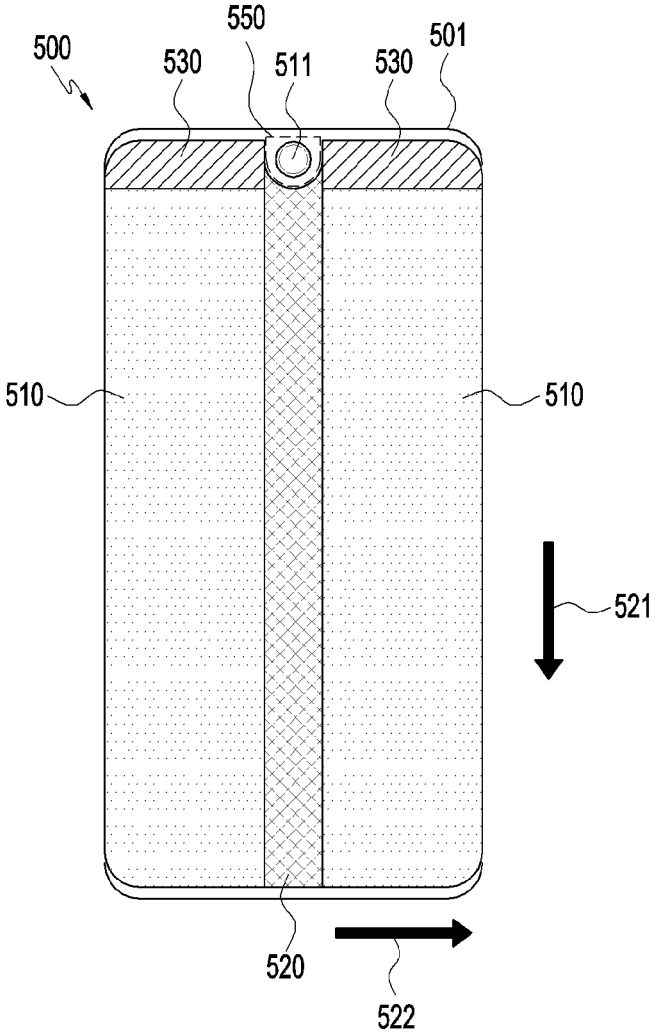
FIG. 5B is an example view illustrating a display panel with a hole area according to various embodiments.

FIG. 5A is an example view illustrating a display panel with a hole area according to various embodiments. FIG. 5B is an example view illustrating a display panel with a hole area according to various embodiments.

According to various embodiments, an electronic device may have a display panel 500 (e.g., the display panel 380 of FIG. 3) expanded over the overall area of the housing of the electronic device 501 (e.g., the electronic device 101 of FIG. 1), as shown in FIG. 5A. If some component (e.g., a front camera 511) of the electronic device 501 is disposed under the display panel 500, opaque metal traces disposed to drive the pixels may influence transmittance. Thus, a hole area 550 where no pixels are positioned may be formed in at least a portion of the display panel 500. According to various embodiments, the hole area 550 may be formed by refraining from forming pixels in at least a portion of the display panel 500 so that the component (e.g., a camera module 511 (e.g., the camera module 180 of FIG. 1), sensor module 176, or sound output device 155) under the display panel 500 is exposed to the outside. Referring to FIG. 5A, according to an embodiment, the hole area 550 may be formed by forming a U-shaped cut in one side of the display panel 500. Although FIG. 5A illustrates that the hole area 550 is a U-shaped cut in one side of the display panel 500, the hole area 550 may be formed in other various shapes in the display panel 500. Further, at least one or more hole areas 550 may be formed in the display panel 500. Hereinafter, an example in which the hole area 550 is included in the display panel 500 is described for ease of description. As such, if the hole area is formed in a portion of the display panel 500, the length of traces connected to the pixels of the display panel 500 and the number of pixels per trace may be varied, so that the total impedance per trace depending on the number of pixels may be varied. Thus, the ELVdd and ELVss which are the electro luminescence (EL) voltages used to be constant per pixel before cutting may be rendered to differ between the pixels in a first area 510 without the hole area 550 and the pixels in a second area 520 with the hole area 550. The brightness of the pixels included in the display panel 500 is adjusted by the source driver applying voltage to the pixels and the ELVdd and ELVss. Thus, in the display panel 500 including the hole area 550, the brightness of pixel may differ per trace disposed in the first direction 521 along which the source driver applies voltage to the pixels. For example, in the display panel 500 including the hole area 550, a difference may be made between the brightness of the pixels in the first area 510 without the cut formed in the first direction and the brightness of the pixels in the second area 520 including the hole area 550.

Referring to FIG. 5B, in the display 500 including the hole area of the electronic device 501 (e.g., the electronic device 101 of FIG. 1), a third area 530, as well as the first area 510 and second area 520, may also have a different brightness. As set forth above, since the brightness of pixels included in the display panel 500 is determined primarily depending on the presence or absence of a pixel, it is adjusted by the source driver that applies voltage to the pixels. However, since the trace formed in the second direction 522 perpendicular to the first direction 521 has an impedance corresponding to its length although smaller than the impedance of the pixel, the pixels in the third area 530 where the front camera 511 is disposed and no traces are arranged may have a different brightness than the pixels arranged in the first area 510 and second area 520. However, since the difference in brightness between the third area 530 and the first area 510 is smaller than the difference in brightness between the second area 520 and the first area 510, the third area 530 and the first area 510 are regarded below as having the same brightness except in a specific embodiment.

Figure 6:
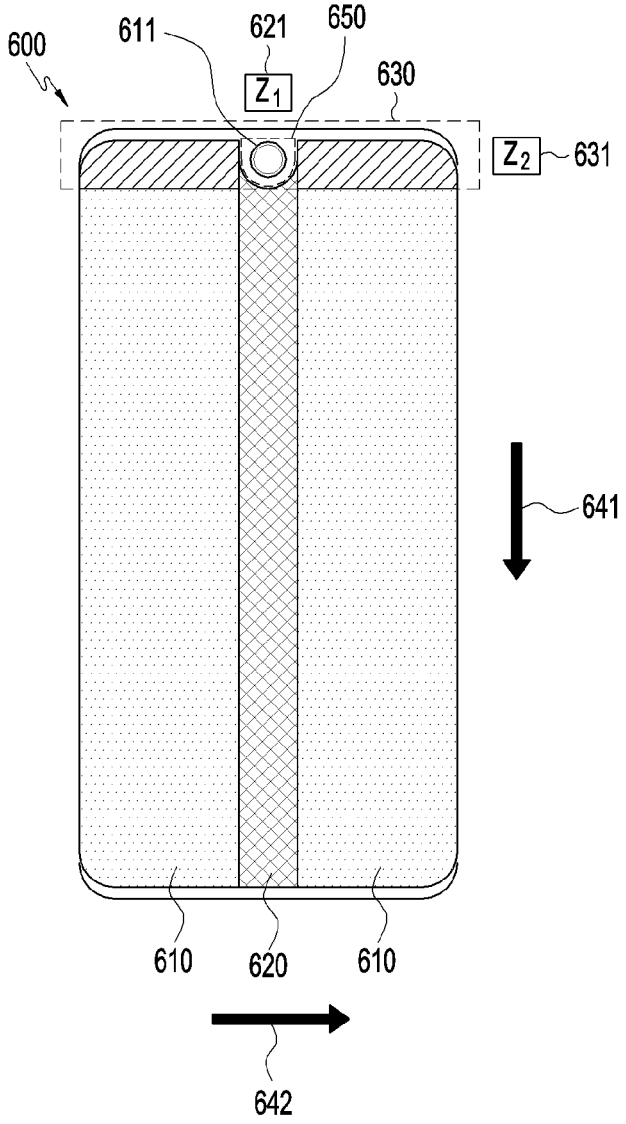
FIG. 6 is a view illustrating an example of compensating for the impedance of a display panel with a hole area according to various embodiments.

FIG. 6 is a view illustrating an example of compensating for the impedance of a display panel with a hole area according to various embodiments.

Referring to FIG. 6, according to various embodiments, a display panel 600 (e.g., the display panel 380 of FIG. 3) may be provided to expand over the overall area of the front housing of the electronic device (e.g., the electronic device 101 of FIG. 1). As set forth above, a hole area 650 may be formed so that a component (e.g., the camera module 611 (e.g., the camera module 180 of FIG. 1), sensor module 176, or sound output device 155) under the display panel 600 is disposed in a portion of the display panel 600. Pixel lines arranged in a first direction 641 in a second area 620 including the hole area 650 and pixel lines arranged in the first direction 641 in first areas 610 not including the hole area 650 may have different pixel counts and different lengths of traces connected with the pixels. Thus, impedance differs due to different pixel counts between the pixel lines arranged in the second area 620 with the hole area 650 and the pixel lines arranged the first areas 610 without the hole area 650. Thus, if the same voltage is supplied, the pixel brightness may differ. For example, the ELVdd and ELVss which used to be constant per pixel may be rendered to differ between the first areas 610 without the hole area 650 and the second area 620 with the hole area 650. Although voltage is applied to the same pixel in the display panel 600 from the source driver, if the ELVdd and ELVss applied to the pixels of the first area 610 and the pixels of the second area 620 are varied, the brightness of the pixels may be varied. In the display panel 600 including the hole area, the traces arranged in the first direction 641 which are influenced by the presence or absence of a pixel and the direction in which the source driver supplies voltage to the pixels may have variations in brightness of pixels caused depending on the presence or absence of the hole area 650. Thus, in the display panel 600 with the hole area, the brightness of pixels may differ between the first area 610 and the second area 620. The display (e.g., the display device 160 of FIG. 1) of the electronic device (e.g., the electronic device 101 of FIG. 1) may include a first compensation circuit 621 for compensating for a difference in impedance between the first area 610 and the second area 620. The first compensation circuit 621 may include at least one of a resistor, an inductor, and a capacitor, and may compensate for impedance corresponding to a difference between a first number of pixels arranged in the first area 610 and a second number of pixels arranged in the second area 620. The first compensation circuit 621 may be disposed on the pixel lines corresponding to the second area 620 so that the pixel lines arranged in the second area 620 and the pixel lines arranged in the first area 610 are configured with the same impedance. If the first compensation circuit 621 is disposed on the pixel lines included in the second area 620 so that the pixel lines included in the first area 610 and the second area 620 are configured with the same impedance, the same EL voltage may be applied to the pixels included in the first area 610 and the second area 620 in response to the power source supplying power to the display 160, so that the pixels may emit light with substantially the same brightness. According to an embodiment, the first compensation circuit 621 may have a designated impedance for outputting light with substantially the same brightness.

As described above in connection with FIG. 5B, in the display 600 including the hole area 650 of the electronic device (e.g., the electronic device 101 of FIG. 1), a third area 630, as well as the first area 610 and second area 620, may also have a different brightness. Since the trace formed in the second direction 642 perpendicular to the first direction 641 has an impedance corresponding to its length although smaller than the impedance of the pixel, the third area 630 where the front camera is disposed and no traces are arranged may have a different brightness than the first area 610. However, the difference in brightness between the third area 530 and the first area 510 may be smaller than the difference in brightness between the second area 520 and the first area 510. If a second compensation circuit 631 is disposed on pixel lines formed in the second direction 642 and included in the third area 630, the sum of the impedances of the pixel lines and the second compensation circuit 631 connected with the traces arranged in the third area 630 may be identical to the sum of the impedances of the pixel lines connected with the traces arranged in the second direction 642 in the first area 610 and the second area 620. If the sum of the impedances of the pixel lines and the second compensation circuit 631 connected with the traces arranged in the third area 630 is set to be the same as the sum of the impedances of the pixel lines connected with the traces arranged in the second direction 642 in the first area 610 and the second area 620, the pixels included in the display panel 600 with the cut may have the same brightness.

Figure 7A:
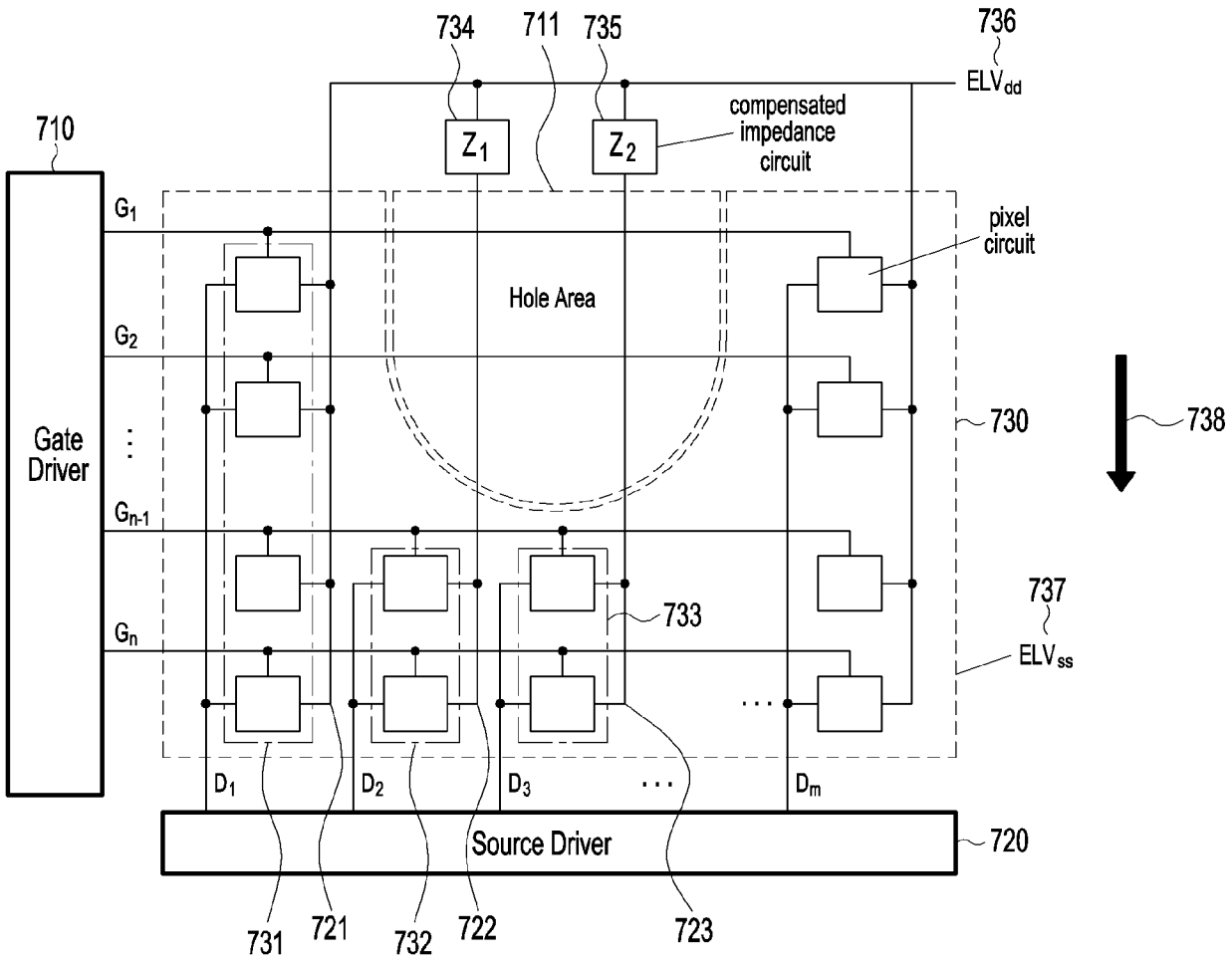
FIG. 7A is a view illustrating an example of compensating for the impedance of a display panel with a hole area according to various embodiments.

FIG. 7A is a view illustrating an example of compensating for the impedance of a display panel with a hole area according to various embodiments.

Referring to FIG. 7A, according to various embodiments, a display (e.g., the display device 160 of FIG. 1) may include a gate driver 710, source driver 720, and a display panel 730 (e.g., the display panel 380) including a first pixel line including a first plurality of pixels 731 formed in a first direction 738 and a second pixel line including a second plurality of pixels 732 formed in the first direction 738. The display panel 730 may include more pixel lines formed in the first direction, such as a third pixel line 733 including a third plurality of pixels, as well as the first pixel line and second pixel line. The display panel 730 may be cut in a U shape to secure a hole area 711 to allow a component (e.g., the camera module 180, sensor module 176, or sound output device 155) disposed thereunder to be exposed to the outside. However, the U-shaped hole area of the display panel 730 is merely an example, and the hole area of the display panel 730 may be formed in other various shapes.

According to various embodiments, the display 160 may include a first trace 721 for supplying power to the first plurality of pixels 731 included in the first pixel line and a second trace 722 for supplying power to the second plurality of pixels 732 included in the second pixel line. The display 160 may include n traces for separately supplying power to n pixel lines included in the display panel 730, as well as the first trace 721 and the second trace 722. The n traces may separately provide power to each pixel. Since the first plurality of pixels 731 and the second plurality of pixels 732 have different numbers of pixels, their respective impedance sums may differ from each other. For example, the number of the second plurality of pixels 732 may be smaller than the number of the first plurality of pixels 731. For example, if the same voltage of ELVdd 736 and ELVss 737 is applied to the second pixel line including the first plurality of pixels 731 and the second pixel line including the second plurality of pixels 732 without a compensation circuit, the voltage applied to each of the first plurality of pixels 731 and the voltage applied to each of the second plurality of pixels 732 may be varied, so that a difference in brightness between the pixels may occur. The display 160 may include a first compensation circuit 734 that is electrically connected with the second trace 722 and compensates for the impedance corresponding to the difference in number between the first plurality of pixels and the second plurality of pixels so as to allow the same voltage to be applied to the first plurality of pixels 731 and the second plurality of pixels 732 so that the same current flows therethrough. The first compensation circuit 734 may be disposed between the second trace 722 and the node to which the ELVdd 736 is applied so that the same voltage as the electro luminescence voltage drain-to-drain (ELVdd) 736 and the electro luminescence voltage source-to-source (ELVss) 737 of the first pixel line is not applied to the second pixel line. For example, the number of the second plurality of pixels 732 may be smaller than the number of the first plurality of pixels 731, and the first compensation circuit 734 may be connected to the second trace and be disposed in the hole area 711 where the second plurality of pixels 732 are not arranged. If a current flows through the first compensation circuit 734, the ELVdd 736 may be dropped by the voltage applied to the first compensation circuit 734, and the same EL voltage as the first plurality of pixels 731 is applied to the second plurality of pixels 732 so that the same brightness is set.

According to an embodiment, the impedance of the compensation circuit disposed along with the pixel line may be varied depending on the size of the hole area 711. For example, referring to FIG. 7A, two pixel lines may be arranged in the hole area 711. To compensate for the electrical load for the third pixel line including the third plurality of pixels 733 connected with the third trace 723 of FIG. 7A, the second compensation circuit 735 may be disposed on the third trace 723. Although FIG. 7A illustrates that the number of the second plurality of pixels 732 is the same as the number of the third plurality of pixels 733, the number of the second plurality of pixels 732 may be identical to or different from the number of the third plurality of pixels 733 and, thus, the first compensation circuit 734 and the second compensation circuit 735 may be identical or different. Although FIG. 7A illustrates that two pixel lines are included in the hole area 711, various embodiments of the disclosure are not limited thereto.

Figure 7B:
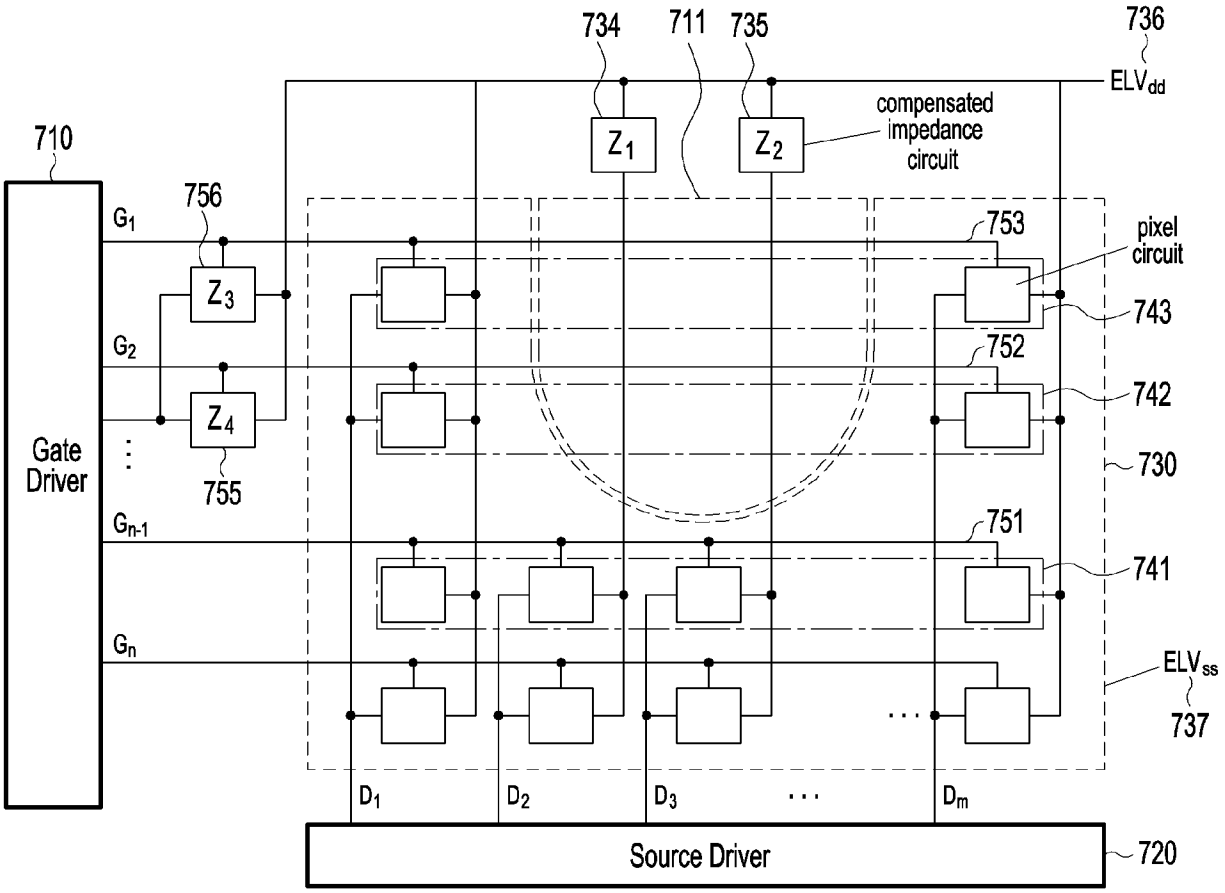
FIG. 7B is a view illustrating an example of compensating for the impedance of a display panel with a hole area according to various embodiments.

FIG. 7B illustrates an example configuration of a display according to various embodiments.

As described above in connection with FIG. 6, in the display 600 including the hole area 650 of the electronic device (e.g., the electronic device 101 of FIG. 1), a third area 630, as well as the first area 610 and second area 620, may also have a different brightness. Since the trace formed in the second direction 642 perpendicular to the first direction 641 has an impedance corresponding to its length although smaller than the impedance of the pixel, the third area 630 where the front camera is disposed and no traces are arranged may have a different brightness than the first area 610. For example, the display may include a circuit for compensating for impedance for the second direction 642.

Referring to FIG. 7B, in the display panel 730 (e.g., the display panel 380 of FIG. 3) including the hole area 711, the first compensation circuit 734 and second compensation circuit 735 for compensating for impedance differences in the first direction 641 may be disposed, and the third compensation circuit 755 and fourth compensation circuit 756 for compensating for impedance differences in the second direction 642 may be disposed, so that the impedance of the overall display panel 730 is uniform or even. The display panel 730 with as large a cut as the hole area 711 may include a fourth pixel line including a fourth plurality of pixels 741 formed in the second direction perpendicular to the first direction and a fifth pixel line including a fifth plurality of pixels 742 formed in the second direction. Since no impedance variation, and thus, no brightness variation, depending on the number of pixels, occurs in the first direction unlike in the second direction, but the trace itself has a resistance, the fourth trace 751 connected with the fourth pixel line and the fifth trace 752 connected with the fifth pixel line may be varied in impedance depending on their lengths. If the fourth trace 751 and the fifth trace 752 have different impedances, a difference in pixel brightness may occur. Thus, the third compensation circuit 755 may be disposed on the fifth trace 752 so that the impedance of the fourth trace 751 is identical to the impedance of the fifth trace 752. Likewise, the fourth compensation circuit 756 may be disposed on the sixth trace 753 so that the fourth trace 751 and the sixth trace 753 are configured with the same impedance. If the fourth impedance 751 through the sixth trace 753 are configured with the same impedance, the fourth plurality of pixels 741, included in the fourth pixel line, through the sixth plurality of pixels 743 may have the same brightness.

Figure 7C:
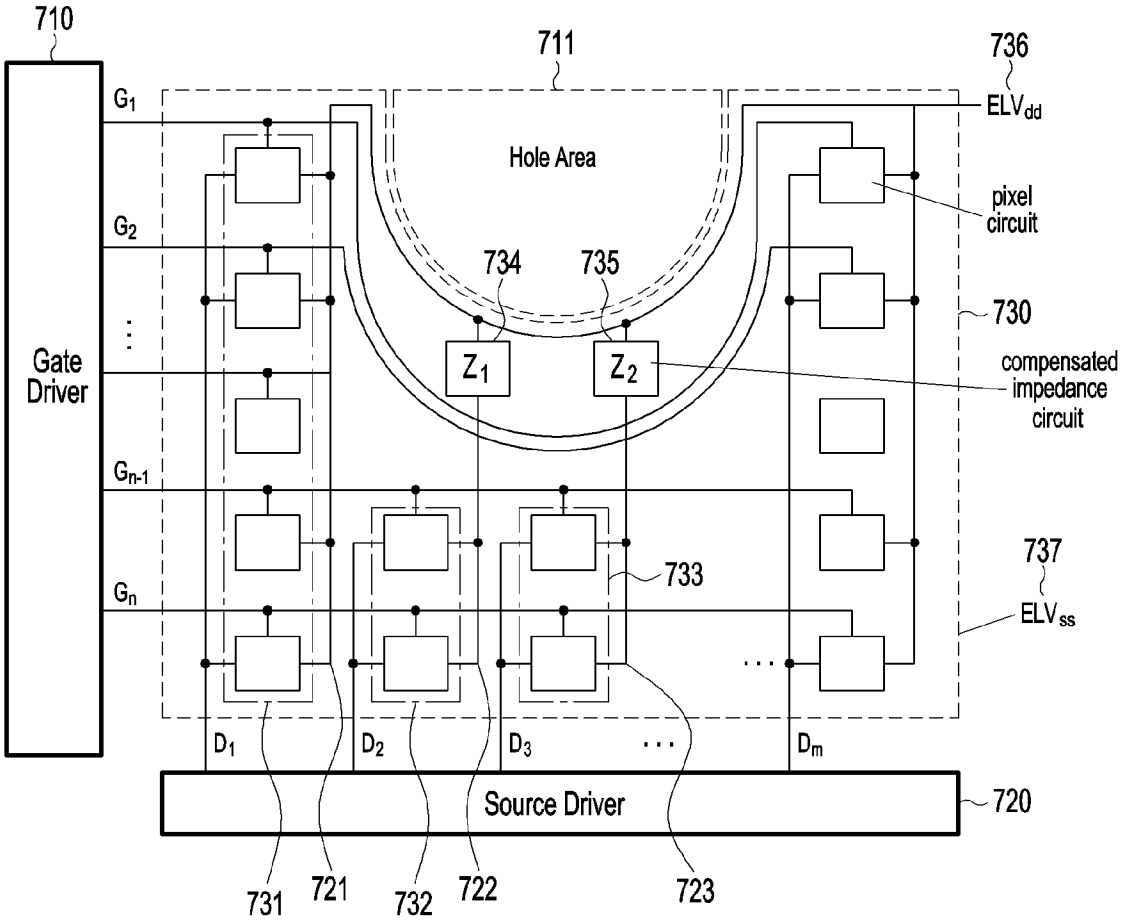
FIG. 7C is a view illustrating an example of compensating for the impedance of a display panel with a hole area according to various embodiments.

FIG. 7C is an example view illustrating a display panel with traces according to various embodiments.

According to various embodiments, a display (not shown) (e.g., the display device 160 of FIG. 1) may include a traces-embedded display panel 730. According to an embodiment, the display panel 730 may include a first pixel line including a first plurality of pixels 731 formed in a first direction, a second pixel line including a second plurality of pixels 732 formed in the first direction, a first trace 721 for supplying power to the first plurality of pixels 731 included in the first pixel line, and a second trace 722 for supplying power to the second plurality of pixels 732 included in the second pixel line. The display panel 730 may include more pixel lines formed in the first direction, as well as the first pixel line and second pixel line. The display panel 730 may include a plurality of traces for separately supplying EL voltages to n pixel lines included in the display panel 730, as well as the first trace 721 and the second trace 722. According to an embodiment, the plurality of traces including the first trace 721 and the second trace 722 may be included or embedded in the display panel 730. Like in FIG. 7A, the display panel 730 may include a first compensation circuit 734 for compensating for the electrical load corresponding to the difference in number between the first plurality of pixels and the second plurality of pixels. For example, the second trace 722 connected with the first compensation circuit 734 may be included in the display panel 730.

According to an embodiment, the impedance of the compensation circuit disposed along with the pixel line may be varied depending on the size of the hole area 711. For example, referring to FIG. 7C, like in FIG. 7A, two pixel lines may be arranged in the hole area 711. To compensate for the impedance differences for the third pixel line including the third plurality of pixels 733 connected with the third trace 723 of FIG. 7C, the second compensation circuit 735 may be disposed on the third trace 723. For example, the third trace 723 connected with the second compensation circuit 735 may be included in the display panel 730. Although FIG. 7C illustrates that the number of the second plurality of pixels 732 is the same as the number of the third plurality of pixels 733, the number of the second plurality of pixels 732 may be identical to or different from the number of the third plurality of pixels 733 and, thus, the first compensation circuit 734 and the second compensation circuit 735 may be identical or different. Although FIG. 7C illustrates that two pixel lines are included in the hole area 711, various embodiments of the disclosure are not limited thereto. Since the components related to the display panel, which do not include traces as shown in FIG. 7A, are likewise applied to the display panel including traces, no detailed description is given.

Figure 8A:
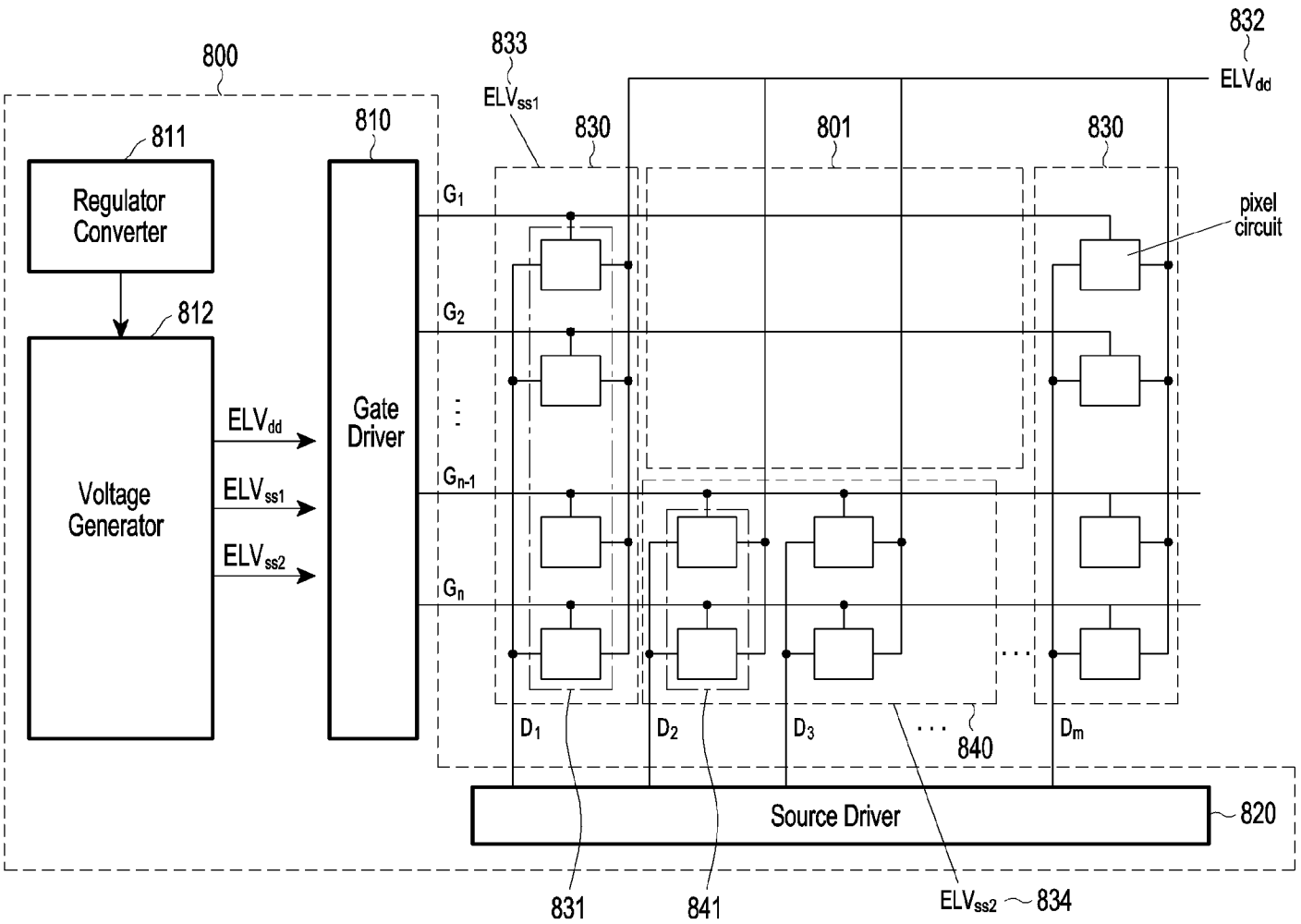
FIG. 8A is a view illustrating an example of compensating for the impedance of a display panel with a hole area, per area, according to various embodiments.
Figure 8B:
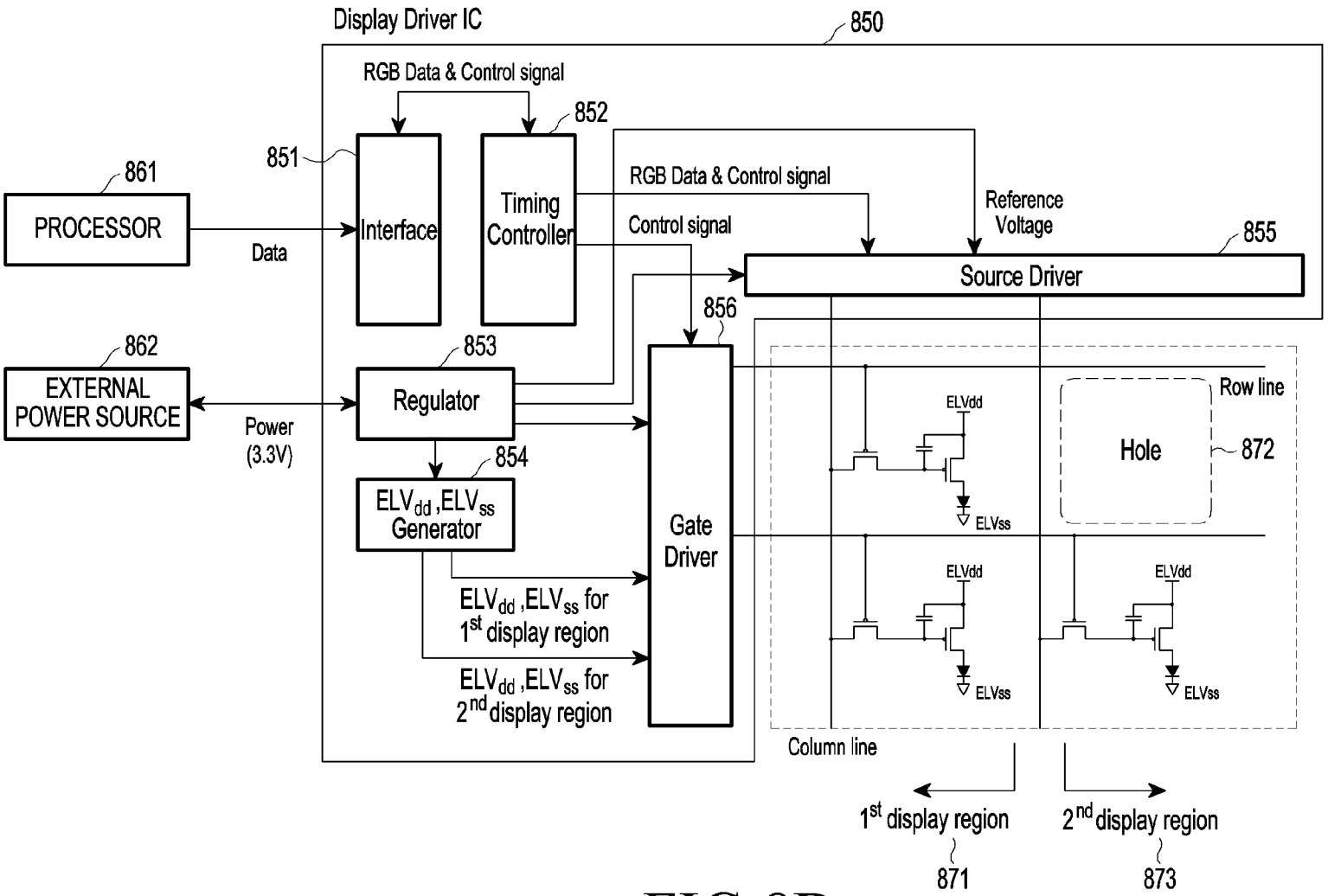
FIG. 8B is a view illustrating an example of compensating for the impedance of a display panel with a hole area, per area, according to various embodiments.
Figure 8C:
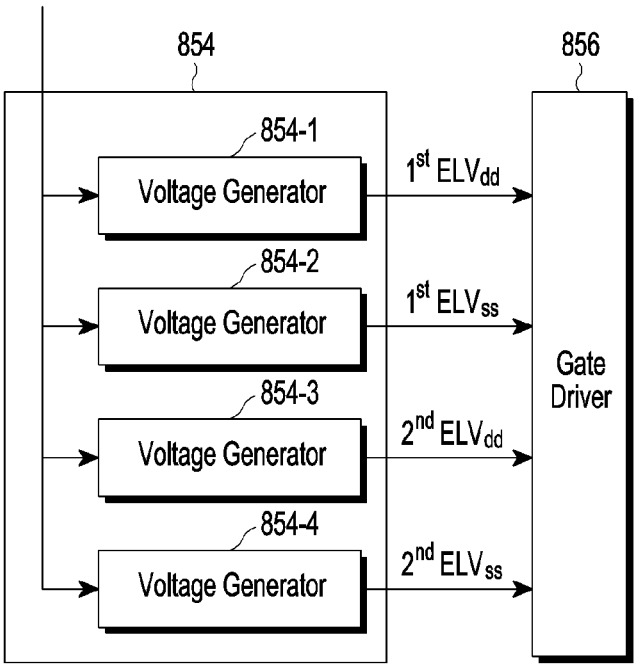
FIG. 8C is a view illustrating an example of compensating for the impedance of a display panel with a hole area, per area, according to various embodiments.
Figure 8D:
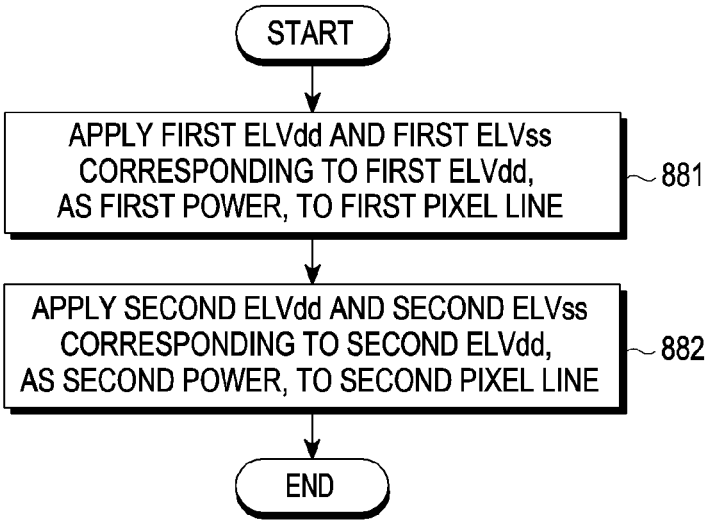
FIG. 8D is a flowchart illustrating a method of compensating for the impedance of a display panel with a hole area, per area, according to various embodiments.

FIG. 8A is a view illustrating an example of compensating for the impedance of a display panel with a hole area, per area, according to various embodiments. FIG. 8B is a view illustrating an example of compensating for the impedance of a display panel with a hole area, per area, according to various embodiments. FIG. 8C is a view illustrating an example of compensating for the impedance of a display panel with a hole area, per area, according to various embodiments. FIG. 8D is a flowchart illustrating a method of compensating for the impedance of a display panel with a hole area, per area, according to various embodiments.

Referring to FIG. 8A, a display driver IC 800 (e.g., the display driver IC 380 of FIG. 3) may be configured to allow the same EL voltage to be applied to each pixel by allowing different EL voltages to be applied to a first plurality of pixels 831 and a second plurality of pixels 841 so as to address a difference in brightness caused by a difference in impedance between the first plurality of pixels 831 included in a first pixel line and the second plurality of pixels 841 due to a hole area 801 included in a display panel (e.g., the display panel 380 of FIG. 3). Referring to FIG. 8A, a regulator 811 (e.g., the DC/DC converter 310 of FIG. 3) of the display driver IC 800 may collectively denote devices that convert low-voltage direct current into alternating current, voltage-transform the alternating current, and rectify the voltage-transformed alternating current into higher-voltage direct current. The regulator 811 may receive power for driving the display driver IC 800 from an external power source (not shown) (e.g., the battery 189 of FIG. 1). The DC/DC converter 811 may transmit a voltage for driving the display driver IC 800 to a voltage generator 812.

The voltage generator 812 may generate a voltage for driving pixels using the voltage received from the DC/DC converter 811. For example, the voltage generator 812 may generate an ELVdd 832, a first ELVss 833, and a second ELVss 834 and apply them to the pixels. For example, the voltage generator 812 may generate one ELVdd 832 or may generate a first ELVdd and a second ELVdd and apply the first ELVdd, as a first power source, to the first pixel line and the second ELVdd, as a second power source, to the second pixel line. Or, the voltage generator 812 may apply the ELVdd 832 and the first ELVss 833 to the first pixel line including the first plurality of pixels 831 and the ELVdd 832 and the second ELVss 834 to the second pixel line including the second plurality of pixels 832. Since the number of the first plurality of pixels 831 is larger than the number of the second plurality of pixels 832, the sum of the impedances of the first plurality of pixels 831 may be larger. The voltage generator 812 may set the difference between the ELVdd and the first ELVss to be larger than the difference between the ELVdd and the second ELVss, thereby allowing the same EL voltage to be applied to each of the pixels included in the first plurality of pixels 831 and the second plurality of pixels 841. Or, the voltage generator 812 may generate and output an additional EL voltage together with the existing EL voltage which is generated in the absence of a hole area. The additional EL voltage generated may be determined to be a voltage which may lead to the same brightness as the pixels in the area with no cut, considering a reduction in the number of pixels and a variation in traces due to the cut area.

Referring to FIG. 8B, according to various embodiments, a display driver IC 850 may include an interface 851 receiving image data and a control signal from a processor 861 (e.g., the processor 120 of FIG. 1) of an electronic device (e.g., the electronic device 101 of FIG. 1), a timing controller 852 transmitting/receiving image data and a control signal to/from the interface 851, transmitting image data and a control signal to the source driver 855, and transmitting a control signal to a gate driver 856, a DC/DC converter 853 receiving power (e.g., 3.3V) from an external power source (e.g., the battery 189 of FIG. 1) included in the electronic device 101, a voltage generator 854 receiving a voltage from the DC/DC converter 853 and transmitting a pixel driving voltage to a pixel included in each area of a display with a hole area 801, a gate driver 856 applying a voltage to a switching TFT included in a pixel circuit of a display panel, and a source driver applying a voltage to a gate of a driving TFT included in a pixel included in the display panel. The regulator 853 may receive a first DC voltage from an external power source 862 (e.g., the battery 189) for the display (e.g., the display 160) and convert the received first DC voltage into a second DC voltage.

In operation 881, the display driver IC 850 may apply a first voltage drain-to-drain (Vdd) and a first voltage source-to-source (Vss) corresponding to the first Vdd, as a first power source, to a first pixel line. In operation 882, the display driver IC 850 may apply a second Vdd and a second Vss corresponding to the second Vdd, as a second power source, to a second pixel line. The voltage generator 854 may receive the second DC voltage from the regulator and generate at least one of a first ELVdd, a first ELVss, a second ELVdd, and an ELVss using the second DC voltage.

According to various embodiments, the display panel with a hole area may include a first area (first display region) 871 with a hole 872 and a second area (second display region) 873 without the hole 872. The voltage generator 854 may generate a first ELVdd voltage and a first ELVss voltage corresponding to the first ELVdd to be applied to the first area 871 and a second ELVdd voltage and a second ELVss voltage corresponding to the second ELVdd to be applied to the second area 872. The voltage generator 854 may set a difference between the first ELVdd voltage and the first ELVss voltage to be larger than a difference between the second ELVdd voltage and the second ELVss voltage so that the same pixel driving voltage is applied to the pixels in the first area 871 and the pixels in the second area 873 and may control to allow the pixels in the display panel to have the same brightness. According to an embodiment, the display driver IC may be configured to adjust at least one of the first ELVdd, the first ELVss, the second ELVdd, or the second ELVss to allow each pixel in the first plurality of pixels and the second plurality of pixels to emit light with the same brightness.

According to various embodiments, a display (e.g., the display device 160 of FIG. 1) may comprise a panel (e.g., the display panel 380 of FIG. 3) including a first pixel line including a first plurality of pixels (e.g., the first plurality of pixels 731 of FIG. 7A) formed in a first direction and a second pixel line including a second plurality of pixels (e.g., the second plurality of pixels 732 of FIG. 7A) formed in the first direction, a first trace (e.g., the first trace 721 of FIG. 7A) for supplying power to the first plurality of pixels (e.g., the first plurality of pixels 731 of FIG. 7A) included in the first pixel line, a second trace for supplying the power to the second plurality of pixels included in the second pixel line, and a compensation circuit (e.g., the first compensation circuit 734 or second compensation circuit 735 of FIG. 7A) electrically connected with the second trace and configured to compensate for an impedance corresponding to a difference in number between the first plurality of pixels and the second plurality of pixels.

According to an embodiment, the compensation circuit (e.g., 734 or 735) may have a designated impedance for allowing each pixel in the first plurality of pixels and the second plurality of pixels to emit light with substantially the same brightness in response to power supplied to the display. According to an embodiment, the compensation circuit (734 or 735) may include one or more passive components to have the designated impedance to allow the same voltage to be applied to each pixel in the first plurality of pixels and the second plurality of pixels in response to the power. According to an embodiment, the same voltage may be configured to be applied, as an ELVdd or ELVss, to each pixel in the first plurality of pixels and the second plurality of pixels. According to an embodiment, the number of the second plurality of pixels may be smaller than the number of the first plurality of pixels. According to an embodiment, the display may further comprise a third pixel line including a third plurality of pixels formed in a second direction perpendicular to the first direction, a fourth pixel line including a fourth plurality of pixels formed in the second direction, a third trace for supplying other power to the third plurality of pixels included in the third pixel line, a fourth trace for supplying the other power to the fourth plurality of pixels included in the fourth pixel line, and a second compensation circuit (e.g., the third compensation circuit 755 or fourth compensation circuit 756 of FIG. 7B) electrically connected with the fourth trace and configured to compensate for another impedance corresponding to a difference in length between the third trace and the fourth trace.

According to various embodiments, a display (e.g., the display device 160 of FIG. 1) may comprise a panel (e.g., the display panel 380 of FIG. 3) including a first pixel line including a first plurality of pixels formed in a first direction and a second pixel line including a second plurality of pixels formed in the first direction, a first trace for supplying first power to the first plurality of pixels included in the first pixel line, a second trace for supplying second power to the second plurality of pixels included in the second pixel line, and a display driver IC (e.g., the display driver IC 230 of FIG. 2) configured to apply a first ELVdd and a first ELVss corresponding to the first ELVdd, as the first power, to the first pixel line and a second ELVdd and a second ELVss corresponding to the second ELVdd, as the second power, to the second pixel line.

According to an embodiment, the display driver IC 230 may be configured to apply the first ELVdd, the first ELVss, the second ELVdd, or the second ELVss to allow each pixel in the first plurality of pixels 731 and the second plurality of pixels 732 to emit light with the same brightness. According to an embodiment, the display driver IC 230 may be configured to control the first ELVdd, the first ELVss, the second ELVdd, or the second ELVss to allow the same voltage to be applied to each pixel in the first plurality of pixels 731 and the second plurality of pixels 732. According to an embodiment, the display driver IC 230 may include a regulator (e.g., the regulator 811 of FIG. 8A) configured to receive a first DC voltage from an external power source for the display and convert the received first DC voltage into a second DC voltage, and a voltage generator (e.g., the voltage generator 812) configured to receive the converted DC voltage from the regulator 811 and generate the first ELVdd, the first ELVss, the second ELVdd, and the second ELVss, using the converted DC voltage. According to an embodiment, the display driver IC 230 may be configured to adjust the first ELVdd, the first ELVss, the second ELVdd, or the second ELVss to allow a first potential difference between the first ELVdd and the first ELVss to be larger than a second potential difference between the second ELVdd and the second ELVss. According to an embodiment, the display driver IC 230 may be configured to apply the same voltage to each pixel in the first plurality of pixels at least partially based on a first potential difference between the first ELVdd and the first ELVss and to apply the same voltage to the second plurality of pixels based on a second potential difference between the second ELVdd and the second ELVss. According to an embodiment, the display 160 may further comprise a trace layer including the first trace and the second trace.

According to various embodiments, a portable electronic device 101 may comprise a display 160 and a battery 189 supplying power to the display 160. The display 160 may comprise a first pixel line including a first plurality of pixels formed in a first direction and a second pixel line including a second plurality of pixels formed in the first direction, a first trace for supplying power to the first plurality of pixels included in the first pixel line, a second trace for supplying the power to the second plurality of pixels included in the second pixel line, and a compensation circuit electrically connected with the second trace and configured to compensate for an impedance corresponding to a difference between a first number of the first plurality of pixels and a second number of the second plurality of pixels.

According to an embodiment, the compensation circuit may have a designated impedance for allowing each pixel in the first plurality of pixels and the second plurality of pixels to emit light with substantially the same brightness in response to power supplied from the battery. According to an embodiment, the same voltage may be configured to be applied, as an ELVdd or ELVss, to each pixel in the first plurality of pixels and the second plurality of pixels. According to an embodiment, the number of the second plurality of pixels may be smaller than the number of the first plurality of pixels.

According to an embodiment, the display 160 may comprise a first trace for supplying power to the first plurality of pixels 731 included in the first pixel line, a second trace for supplying the power to the second plurality of pixels 732 included in the second pixel line, the first pixel line including the first plurality of pixels 731 formed in the first direction, and the second pixel line including the second plurality of pixels 732 formed in the first direction, and a compensation circuit (e.g., the first compensation circuit 734 or second compensation circuit 735 of FIG. 7A) configured to compensate for the impedance corresponding to a difference in number between the first plurality of pixels 731 and the second plurality of pixels 732.

According to an embodiment, the compensation circuit (e.g., 734 or 735) may have a designated value for allowing the second plurality of pixels 732 to be displayed in substantially the same brightness as the first plurality of pixels 731. According to an embodiment, the compensation circuit (e.g., 734 or 735) may include passive components to allow the same voltage to be applied to the second plurality of pixels 732 connected with the second trace and the first plurality of pixels 731 connected with the first trace. According to an embodiment, the voltage may include at least one of the ELVdd voltage and ELVss voltage applied to each pixel. According to an embodiment, the first plurality of pixels 731 of the first pixel line and the second plurality of pixels 732 of the second pixel line may be arranged at the same interval from a first surface of the display panel 380, and the compensation circuit 734 or 735 may be connected with the second trace and be disposed in an area where the second plurality of pixels 732 are not arranged. According to an embodiment, the panel may include a third pixel line including a third plurality of pixels formed in a second direction perpendicular to the first direction, a fourth pixel line including a fourth plurality of pixels formed in the second direction, a third trace for supplying power to the third plurality of pixels included in the third pixel line, a fourth trace for supplying the power to the fourth plurality of pixels included in the fourth pixel line, and a second compensation circuit 755 or 756 electrically connected with the fourth trace and configured to compensate for an electrical load corresponding to a difference in number between the third plurality of pixels and the fourth plurality of pixels.

According to various embodiments, a display 160 may comprise a panel 380 including a first trace for supplying power to a first plurality of pixels included in a first pixel line, a second trace for supplying the power to a second plurality of pixels included in a second pixel line, the first pixel line including the first plurality of pixels formed in a first direction, and the second pixel line including the second plurality of pixels formed in the first direction, and a display driver IC 230 configured to apply a first EL voltage and a second EL voltage to the first pixel line and a third EL voltage and a fourth EL voltage to the second pixel line.

According to an embodiment, the display driver IC 230 may apply the first voltage, the second voltage, the third voltage, and the fourth voltage to display the second plurality of pixels in substantially the same brightness as the first plurality of pixels. According to an embodiment, the display driver IC 230 may control the first voltage, the second voltage, the third voltage, and the fourth voltage to allow the same voltage to be applied to each of the first plurality of pixels and the second plurality of pixels. According to an embodiment, the display driver IC 230 may include a regulator receiving a DC voltage from an external power source and converting the received DC voltage and a voltage generator receiving the converted DC voltage from the regulator and generating the first voltage and second voltage applied to the first pixel line and the third voltage and fourth voltage applied to the second pixel line using the converted DC voltage. According to an embodiment, the display driver IC 230 may set the difference between the first voltage and the second voltage to be larger than the difference between the third voltage and the fourth voltage. According to an embodiment, the display driver IC 230 may be configured to apply the same voltage to the first plurality of pixels based on the difference between the first voltage and the second voltage and to apply the same voltage to the second plurality of pixels based on the difference between the third voltage and the fourth voltage. According to an embodiment, the display 160 may further comprise a trace layer including the first trace and the second trace.

According to various embodiments, a display 160 may comprise a panel 380 including a first trace for supplying power to a first plurality of pixels included in a first pixel line, a second trace for supplying the power to a second plurality of pixels included in a second pixel line, the first pixel line including the first plurality of pixels formed in a first direction, and the second pixel line including the second plurality of pixels formed in the first direction, and a compensation circuit electrically connected with the second trace and configured to compensate for an impedance corresponding to a difference in number between the first plurality of pixels and the second plurality of pixels.

According to an embodiment, the compensation circuit may have a designated value for allowing the second plurality of pixels to be displayed in substantially the same brightness as the first plurality of pixels. According to an embodiment, the compensation circuit may include passive components to allow the same voltage to be applied to the second plurality of pixels connected with the second trace and the first plurality of pixels connected with the first trace. According to an embodiment, the same voltage may include at least one of the ELVdd voltage and ELVss voltage applied to each pixel. According to an embodiment, the first plurality of pixels of the first pixel line and the second plurality of pixels of the second pixel line may be arranged at the same interval from a first surface of the display panel, and the compensation circuit may be connected with the second trace and be disposed in an area where the second plurality of pixels are not arranged. According to an embodiment, the panel may include a third pixel line including a third plurality of pixels formed in a second direction perpendicular to the first direction, a fourth pixel line including a fourth plurality of pixels formed in the second direction, a third trace for supplying a threshold voltage to the third plurality of pixels included in the third pixel line, a fourth trace for supplying the threshold voltage to the fourth plurality of pixels included in the fourth pixel line, and a second compensation circuit electrically connected with the fourth trace and configured to compensate for an impedance corresponding to a difference in length between the third trace connected with the third pixel line and the fourth trace connected with the fourth pixel line.

The electronic device according to various embodiments may be one of various types of electronic devices. The electronic devices may include at least one of, e.g., a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the techniques set forth herein to particular embodiments and that various changes, equivalents, and/or replacements therefor also fall within the scope of the disclosure. The same or similar reference denotations may be used to refer to the same or similar elements throughout the specification and the drawings. It is to be understood that the singular forms "a," "an," and "the" include plural references unless the context clearly dictates otherwise. As used herein, the term "A or B," "at least one of A and/or B," "A, B, or C," or "at least one of A, B, and/or C" may include all possible combinations of the enumerated items. As used herein, the terms "first" and "second" may modify various components regardless of importance and/or order and are used to distinguish a component from another without limiting the components. It will be understood that when an element (e.g., a first element) is referred to as being (operatively or communicatively) "coupled with/to," or "connected with/to" another element (e.g., a second element), it can be coupled or connected with/to the other element directly or via a third element.

As used herein, the term "module" includes a unit configured in hardware, software, or firmware and may interchangeably be used with other terms, e.g., "logic," "logic block," "part," or "circuit." A module may be a single integral part or a minimum unit or part for performing one or more functions. For example, the module may be configured in an application-specific integrated circuit (ASIC).

Various embodiments as set forth herein may be implemented as software (e.g., the program 140) containing commands that are stored in a machine (e.g., computer)-readable storage medium (e.g., an internal memory 136) or an external memory 138. The machine may be a device that may invoke a command stored in the storage medium and may be operated as per the invoked command. The machine may include an electronic device (e.g., the electronic device 101) according to embodiments disclosed herein. When the command is executed by a processor (e.g., the processor 120), the processor may perform a function corresponding to the command on its own or using other components under the control of the processor. The command may contain a code that is generated or executed by a compiler or an interpreter. The machine-readable storage medium may be provided in the form of a non-transitory storage medium. Here, the term "non-transitory" simply means that the storage medium does not include a signal and is tangible, but this term does not differentiate between where data is semipermanently stored in the storage medium and where data is temporarily stored in the storage medium.

According to an embodiment, a method according to various embodiments of the disclosure may be included and provided in a computer program product. The computer program products may be traded as commodities between sellers and buyers. The computer program product may be distributed in the form of a machine-readable storage medium (e.g., a compact disc read only memory (CD-ROM)) or online through an application store (e.g., Playstore™). When distributed online, at least part of the computer program product may be temporarily generated or at least temporarily stored in a storage medium, such as the manufacturer's server, a server of the application store, or a relay server.

According to various embodiments, each component (e.g., a module or program) may be configured of a single or multiple entities, and the various embodiments may exclude some of the above-described sub components or add other sub components. Alternatively or additionally, some components (e.g., modules or programs) may be integrated into a single entity that may then perform the respective (pre-integration) functions of the components in the same or similar manner. According to various embodiments, operations performed by modules, programs, or other components may be carried out sequentially, in parallel, repeatedly, or heuristically, or at least some operations may be executed in a different order or omitted, or other operations may be added.

The invention claimed is:

1. A display, comprising:

a first pixel line including a first plurality of pixels formed in a first direction;

a second pixel line including a second plurality of pixels formed in the first direction;

a third pixel line including a third plurality of pixels formed in a second direction perpendicular to the first direction;

a fourth pixel line including a fourth plurality of pixels formed in the second direction;

a first trace for supplying power to the first plurality of pixels included in the first pixel line;

a second trace for supplying the power to the second plurality of pixels included in the second pixel line;

a third trace for supplying other power to the third plurality of pixels included in the third pixel line;

a fourth trace for supplying the other power to the fourth plurality of pixels included in the fourth pixel line;

a compensation circuit electrically connected between the second trace and a power source, and configured to compensate for an impedance corresponding to a difference between a first number of the first plurality of pixels and a second number of the second plurality of pixels; and a second compensation circuit electrically connected with the fourth trace and configured to compensate for another impedance corresponding to a difference in length between the third trace and the fourth trace.

2. The display of claim 1, wherein the compensation circuit has a designated impedance for allowing each pixel in the first plurality of pixels and the second plurality of pixels to emit light with substantially a same brightness in response to the power source supplying power to the display.

3. The display of claim 2, wherein the compensation circuit includes one or more passive components to have the designated impedance to allow a same voltage to be applied to each pixel in the first plurality of pixels and the second plurality of pixels in response to the power source.

4. The display of claim 3, wherein the compensation circuit is configured to allow the same voltage, as an electro-luminescence voltage drain-to-drain (ELVdd) or electro-luminescence voltage source-to-source (ELVss), to be applied to each pixel in the first plurality of pixels and the second plurality of pixels.

5. The display of claim 1, wherein the second number of the second plurality of pixels is smaller than the first number of the first plurality of pixels.

6. The display of claim 1, wherein the first pixel line and the second pixel line form at least a portion of a panel.

7. The display of claim 6, wherein a trace layer including the first trace and the second trace is formed under the panel.

8. A display, comprising:

a panel including a first pixel line including a first plurality of pixels formed in a first direction and a second pixel line including a second plurality of pixels formed in the first direction wherein a number of the second plurality of pixels is different from the number of the first plurality of pixels;

a first trace for supplying first power to the first plurality of pixels included in the first pixel line;

a second trace for supplying second power to the second plurality of pixels included in the second pixel line; and a display driver IC configured to apply a first voltage drain-to-drain (Vdd) and a first voltage source-to-source (Vss) corresponding to the first Vdd, as the first power, to the first pixel line and a second Vdd and a second Vss corresponding to the second Vdd, as the second power, to the second pixel line, wherein the first Vdd and the first Vss are obtained based on the number of the first plurality of pixels, and the second Vdd and the second Vss are obtained based on the number of the second plurality of pixels, and wherein a difference between the first Vdd and the first Vss is different from a difference between the second Vdd and the second Vss.

9. The display of claim 8, wherein the display driver IC is configured to adjust the first Vdd, the first Vss, the second Vdd, or the second Vss to allow each pixel in the first plurality of pixels and the second plurality of pixels to emit light with a same brightness.

10. The display of claim 8, wherein the display driver IC is configured to adjust the first Vdd, the first Vss, the second Vdd, or the second Vss to allow a same voltage to be applied to each pixel in the first plurality of pixels and the second plurality of pixels.

11. The display of claim 8, wherein the display driver IC includes:

a regulator configured to receive a first DC voltage from an external power source for the display and convert the received first DC voltage into a second DC voltage; and a voltage generator configured to receive the second DC voltage from the regulator and generate a corresponding voltage among the first Vdd, the first Vss, the second Vdd, and the second Vss, using the second DC voltage.

12. The display of claim 8, wherein the display driver IC is configured to adjust the first Vdd, the first Vss, the second Vdd, or the second Vss to allow a first potential difference between the first Vdd and the first Vss to be larger than a second potential difference between the second Vdd and the second Vss.

13. The display of claim 8, wherein the display driver IC is configured to apply a same voltage to each pixel in the first plurality of pixels at least partially based on a first potential difference between the first Vdd and the first Vss and to apply a same voltage to each pixel in the second plurality of pixels at least partially based on a second potential difference between the second Vdd and the second Vss.

14. The display of claim 8, further comprising a trace layer including the first trace and the second trace.

* * * * *